US007156572B2

(12) United States Patent
Gueret

(10) Patent No.: US 7,156,572 B2
(45) Date of Patent: Jan. 2, 2007

(54) DEVICE AND METHOD FOR PACKAGING AND APPLYING A SUBSTANCE

(75) Inventor: Jean-Louis H. Gueret, Paris (FR)

(73) Assignee: L'Oreal S.A., Paris (FR)

( * ) Notice: Subject to any disclaimer, the term of this patent is extended or adjusted under 35 U.S.C. 154(b) by 0 days.

(21) Appl. No.: 10/849,900

(22) Filed: May 21, 2004

(65) Prior Publication Data

US 2004/0213625 A1 Oct. 28, 2004

Related U.S. Application Data

(62) Division of application No. 09/968,988, filed on Oct. 3, 2001, now Pat. No. 6,773,187.

(30) Foreign Application Priority Data

Oct. 3, 2000 (FR) ..... 00 12593

(51) Int. Cl.
*A45D 33/00* (2006.01)
*A46B 11/00* (2006.01)
*A47L 1/08* (2006.01)

(52) U.S. Cl. ..... 401/130; 401/126; 401/16; 401/25

(58) Field of Classification Search ..... 401/118, 401/123, 124, 125, 130, 216, 122, 16, 25; 132/307
See application file for complete search history.

(56) References Cited

U.S. PATENT DOCUMENTS 1,021,709 A 3/1912 Snow
1,056,457 A 3/1913 Schloss
1,063,484 A 6/1913 Weismantel
1,172,293 A 2/1916 Kohlhepp
1,450,386 A 4/1923 Regan
2,069,048 A 1/1937 Rehberger (Continued)

FOREIGN PATENT DOCUMENTS

CH 406 544 8/1966

(Continued)

OTHER PUBLICATIONS

Co-pending U.S. Appl. No. 09/666,450, filed Sep. 21, 2000.

(Continued)

*Primary Examiner*—David J. Walczak
(74) *Attorney, Agent, or Firm*—Finnegan, Henderson, Farabow, Garrett & Dunner, LLP

(57) ABSTRACT

A device for packaging and applying a substance may comprise a receptacle for containing the substance and at least one housing in flow communication with the receptacle. The at least one housing may be configured to receive an applicator element and may comprise a side wall and an end wall. The device may also comprise at least one applicator element for applying the substance. The at least one applicator element may comprise a first portion configured to abut the end wall when the at least one applicator element is at least partially received in the at least one housing and the first portion is in an uncompressed configuration. The at least one applicator element may also comprise a second portion comprising at least one recess. The second portion may be configured to abut the end wall when the at least one applicator element is at least partially received in the at least one housing and the first portion is in a compressed configuration. The at least one applicator element may also comprise a peripheral portion configured to abut the side wall when the at least one applicator element is received in the at least one housing.

39 Claims, 10 Drawing Sheets

U.S. PATENT DOCUMENTS

| | | | | | |
|---|---|---|---|---|---|
| 2,554,489 | A | | 5/1951 | Crane | |
| 2,691,184 | A | | 10/1954 | Miller et al. | |
| 2,699,885 | A | | 1/1955 | McClure | |
| 3,456,650 | A | | 7/1969 | Schwartzman | |
| 3,456,851 | A | | 7/1969 | Mattes et al. | |
| 3,592,365 | A | | 7/1971 | Schwartzman | |
| 3,682,558 | A | | 8/1972 | Miller | |
| 3,951,157 | A | * | 4/1976 | Idec | 401/122 |
| 4,164,377 | A | * | 8/1979 | Lohrman et al. | 401/213 |
| 4,359,292 | A | * | 11/1982 | Thompson et al. | 401/215 |
| 4,693,623 | A | | 9/1987 | Schwartzman | |
| 4,780,017 | A | | 10/1988 | Bradford | |
| 4,832,060 | A | | 5/1989 | Kingsford | |
| 4,925,327 | A | | 5/1990 | Wirt | |
| 4,929,108 | A | | 5/1990 | Gueret | |
| 4,974,981 | A | | 12/1990 | Bennett | |
| 5,137,387 | A | * | 8/1992 | Byrd et al. | 401/122 |
| 5,492,426 | A | * | 2/1996 | Gueret | 401/126 |
| 5,573,340 | A | * | 11/1996 | Gueret | 401/126 |
| 5,636,931 | A | | 6/1997 | Gueret | |
| 5,945,076 | A | | 8/1999 | Leonard et al. | |
| 6,296,410 | B1 | * | 10/2001 | Ruizendaal | 401/119 |
| 6,309,124 | B1 | | 10/2001 | Gueret | |
| 6,447,191 | B1 | * | 9/2002 | Vasas | 401/7 |

FOREIGN PATENT DOCUMENTS

| | | |
|---|---|---|
| DE | 938 658 | 2/1956 |
| DE | 2 132 433 | 1/1973 |
| EP | 163-189 A | 12/1985 |
| EP | 0 416 185 A1 | 3/1991 |
| EP | 0 416 186 A2 | 3/1991 |
| EP | 0 612 488 A1 | 8/1994 |
| EP | 0 688 516 A1 | 12/1995 |
| EP | 0 855 177 A2 | 7/1998 |
| EP | 1 086 904 | 3/2001 |
| EP | 1 094 011 | 4/2001 |
| GB | 403219 | 12/1933 |
| GB | 1158412 | 7/1969 |
| JP | U 64-39879 | 3/1989 |
| JP | A 2-98306 | 4/1990 |
| JP | U 03-57089 | 5/1991 |
| JP | U 6-3473 | 1/1994 |
| JP | A 6-296520 | 10/1994 |
| JP | A 7-313247 | 12/1995 |
| JP | 2000-202354 | 7/2000 |

OTHER PUBLICATIONS

Amendment filed Oct. 24, 2002, in co-pending U.S. Appl. No. 09/666,450.

Amendment filed May 3, 2002, in co-pending U.S. Appl. No. 09/666,450.

Supplemental Preliminary Amendment and Response to Restriction Requirement filed Oct. 24, 2001, in co-pending U.S. Appl. No. 09/666,450.

Supplemental Preliminary Amendment filed Oct. 31, 2000, in co-pending U.S. Appl. No. 09/666,450.

Preliminary Amendment filed Sep. 21, 2000, in co-pending U.S. Appl. No. 09/666,450.

English language translation of Switzerland 406 544.

English language translation of DE 2 132 433.

Partial English language translation of JP U 64-39879.

Partial English language translation of JP U 03-57089.

Partial English language translation of JP U 6-3473.

English Language Derwent Abstract of EP 1 086 904, Mar. 28, 2001.

English Language Derwent Abstract of EP 1 094 011, Apr. 25, 2001.

* cited by examiner

DEVICE AND METHOD FOR PACKAGING AND APPLYING A SUBSTANCE

This application is a divisional application of U.S. application Ser. No. 09/968,988, filed Oct. 3, 2001 now U.S. Pat. No. 6,773,187, which is incorporated herein by reference.

The present invention relates to a device for packaging and applying a substance, for example, a cosmetic or a care product. The device may include a receptacle for containing the substance and an applicator optionally including a compressible applicator element for applying the substance. The device may also include a housing for receiving the applicator element and for filling or loading the applicator element with a supply of the substance.

An example of a conventional device is found in Swiss patent CH 406 544. In the device of the Swiss patent, the applicator element is fixed on a support element that bears against the walls of the housing in such a manner that the applicator element is not compressed in the housing when the applicator is in place on the receptacle. Additionally, the applicator is not arranged in such a manner that it closes the housing in sealed manner when the applicator is located on the receptacle.

There exists a need for a device that may include a receptacle for containing a substance, and an applicator that may include an applicator element for use in applying the substance. The device may further include a housing for receiving the applicator element and for filling it with substance. Such a device may be adapted to package and dispense a substance, such as those substances having a liquid to semisolid consistency, or a powder. Further, such a device may optionally be capable of filling the applicator element with a substantial quantity of substance to enable the applicator to be used for a sufficient length of time between refills.

In accordance with the purpose of the invention, as embodied and broadly described herein, the invention includes a device for packaging and applying a substance. The device may comprise a receptacle for containing the substance and at least one housing in flow communication with the receptacle. The at least one housing may be configured to receive an applicator element and may comprise a side wall and an end wall. The interior of the at least one housing may be separated from the substance by the end wall. The device may also comprise at least one applicator element for applying the substance. The at least one applicator element may be compressible, for example. Alternatively, the at least one applicator element may be substantially incompressible. For example, the applicator element could include a sintered material optionally with flocking. The at least one applicator element may comprise a first portion configured to abut the end wall when the at least one applicator element is at least partially received in the at least one housing and the first portion is in an uncompressed configuration. The at least one applicator element may also comprise a second portion comprising at least one recess. The second portion may comprise a single recess or a plurality of recesses. The second portion may be configured to abut the end wall when the at least one applicator element is at least partially received in the at least one housing and the first portion is in a compressed configuration. The at least one applicator element may also comprise a peripheral portion configured to abut the side wall when the at least one applicator element is received in the at least one housing.

In an optional aspect, the second portion of the at least one applicator element may comprise a truncated cone when the second portion is in an uncompressed configuration. In another optional aspect, the second portion may form a depression when the second portion is in an uncompressed configuration.

The at least one applicator element optionally further comprises a face having a central region. The second portion could, for example, be located on the central region.

The at least one applicator element may further comprise a sealing member configured to close the at least one housing in a sealed manner when the at least one applicator element is received at least partially in the at least one housing.

In still another optional aspect, the first portion of the at least one applicator element could substantially surround the second portion. Optionally, the peripheral portion of the at least one applicator element is configured to seal against the side wall of the at least one housing.

The end wall of the housing may have a portion with at least one orifice configured to supply the at least one applicator element with substance. For example, the end wall may comprise a plurality of orifices configured to supply the at least one applicator element with the substance.

The second portion of the at least one applicator element may be configured to be compressed in an axial direction when the at least one applicator element is received in the at least one housing.

In another optional aspect, the at least one applicator element may be configured to contact substantially the entire end wall when the at least one applicator element is received in the at least one housing.

The at least one applicator element may further comprise a lid configured to be secured to the at least one housing by rotation and to provide a handle. Alternatively, the lid could be configured to be secured to the at least one housing by translation and to provide a handle.

In an optional aspect, the at least one applicator element may comprise at least one depressed portion defined by a groove. Optionally, the at least one applicator element may comprise a plurality of parallel grooves or a plurality of depressed portions arranged in a grid configuration. In still another optional aspect, the at least one applicator element may comprise a plurality of bosses.

In another aspect, the at least one applicator element optionally may have a diameter of at least about 20 millimeters. Alternatively, the at least one applicator element could have a diameter of at least about 30 millimeters or at least about 40 millimeters. The at least one applicator element could comprise, for example, an open-cell foam.

The end wall of the at least one housing may be substantially planar or it may be substantially concave when viewed from an interior of the at least one housing.

The first portion of the at least one applicator element may be radially symmetrical in shape. The first portion could also comprise regions having different heights in the uncompressed configuration, wherein the regions having different heights abut the end wall in the compressed configuration when the at least one applicator element is received in the at least one housing.

The end wall of the at least one housing may be fixed with respect to the receptacle.

In another aspect, the device may further comprise a pump for delivering substance into the at least one housing. Alternatively, the substance may be supplied to the at least one applicator element by capillary action.

In still another aspect, the at least one applicator element may be configured such that the substance is drawn into the at least one housing as the at least one applicator element is removed from the housing thereby creating a suction effect.

In an optional aspect, the first portion of the at least one applicator element may be configured to be in a compressed configuration when the at least one applicator element is received in the at least one housing and to expand as the at least one applicator element is removed from the at least one housing, thereby drawing a supply of the substance into the at least one housing.

In another optional aspect, the receptacle may be configured to elastically deform. For example, a supply of the substance may be delivered into the at least one housing upon compression of the receptacle.

In an additional optional aspect, the at least one applicator element and the end wall may be configured to define a substantially enclosed cavity in fluid communication with the at least one orifice when the at least one applicator element is received at least partially in the housing.

The at least one applicator element may have a compressed configuration when the at least one applicator element is received at least partially in the at least one housing.

In an optional aspect, the receptacle may contain a substance. For example, the receptacle may contain a care product for application to skin, such as a lotion and/or a cream. The receptacle may contain any number of products including, for example, a cosmetic product, a lip care product, a lip make-up product, a nail varnish, a hair product, such as a hair treatment product or hair coloring product, and/or any other product desired to be applied to a surface.

In another optional aspect, the device may comprise two housings and two applicator elements.

In still another optional aspect, the invention may include a method of applying a substance to skin. The method optionally comprises providing a substance in the receptacle of a device and delivering a supply of the substance from the receptacle to the at least one applicator element. The method may further comprise removing the at least one applicator element from the at least one housing and applying the substance to the skin.

The term "providing" is used in a broad sense, and refers to, but is not limited to, making available for use, enabling usage, giving, supplying, obtaining, getting a hold of, acquiring, purchasing, selling, distributing, possessing, making ready for use, and/or placing in a position ready for use.

The delivering of the supply of the substance to the at least one housing may comprise, for example, drawing the supply of the substance into the at least one housing as the peripheral portion of the at least one applicator element slides on the side wall thereby creating a suction effect.

The at least one applicator element may optionally expand as the at least one applicator element is removed from the at least one housing.

In an optional aspect, the delivering of the supply of the substance may comprise activating a pump.

In another optional aspect, the invention may comprise a device for packaging and applying a substance comprising a receptacle for containing the substance and at least one housing comprising a side wall and an end wall. The at least one housing may be configured to receive an applicator element. The device may further comprise at least one applicator element comprising a first portion configured to abut the end wall when the at least one applicator element is received in the at least one housing and a peripheral portion configured to abut the side wall when the at least one applicator element is at least partially received in the at least one housing. The device may also comprise a substantially enclosed cavity defined at least partially by the end wall and the at least one applicator element when the at least one applicator element is at least partially received in the at least one housing. The substantially enclosed cavity may be between the end wall and the at least one applicator element.

The at least one applicator element may be, for example, frustoconical-shaped and the peripheral portion may comprise a chamfered portion. Optionally, the at least one applicator element comprises a tip and the cavity substantially surrounds the tip.

Optionally, the at least one applicator element has the shape of a truncated cone when the at least one applicator element is in the uncompressed configuration.

In another optional aspect, the invention may include a device for packaging and applying a substance comprising a receptacle for containing the substance and at least one housing capable of being in flow communication with the receptacle. The at least one housing may be configured to receive an applicator element and may comprise at least one end wall. The at least one housing may be axially fixed with respect to the receptacle. The device may also comprise at least one applicator element. The at least one applicator element and the at least one end wall may define a substantially enclosed cavity within the at least one housing. The substantially enclosed cavity may extend at least partially between the at least one end wall and the at least one applicator element when the at least one applicator element is received at least partially in the at least one housing. The at least one applicator element may define one of at least one recess, at least one flat portion, and at least one truncated portion when the at least one applicator element is removed from the housing.

Optionally, the at least one end wall is flexible.

In an optional aspect, the invention may include a device for packaging and applying a substance. The device may comprise a receptacle for containing the substance and at least one housing capable of being in flow communication with the receptacle. The at least one housing may be configured to receive an applicator element. The device may also comprise at least one recess defined by the at least one housing and at least one applicator element. The at least one applicator element may be capable of occupying at least a major part of the at least one recess when the at least one applicator element is received at least partially in the at least one housing.

In an optional embodiment, the at least one housing may comprise at least one end wall having a stepped portion. The at least one recess may be defined by the stepped portion of the at least end one wall.

Optionally, the at least one housing comprises at least one end wall defining the recess and the at least one end wall comprises at least one orifice configured to provide flow communication between the housing and the receptacle.

The at least one applicator element may comprise a substantially planar face when the at least one applicator element is in an uncompressed configuration. Optionally, the at least one applicator element comprises at least one recess. The at least one end wall could optionally be flexible.

In yet another optional aspect, the invention may include a device for packaging and applying a substance comprising a receptacle for containing the substance and at least one housing capable of being in flow communication with the receptacle. The at least one housing may be configured to receive an applicator element and may comprise at least one end wall. Optionally, the at least one housing is fixed axially with respect to the receptacle. The device may also comprise at least one applicator element. The at least one applicator element and the at least one end wall may define a substantially enclosed cavity therebetween such that the at least one applicator element substantially surrounds the substantially enclosed cavity when the at least one applicator element is received at least partially in the at least one housing. Optionally, the at least one end wall comprises at least one orifice configured to provide flow communication between the at least one housing and the receptacle. Alternatively, the at least one end wall may contain porous material configured to provide flow communication between the at least one housing and the receptacle.

In still another optional aspect, the invention may include a device for packaging and applying a substance comprising a receptacle for containing the substance and at least one housing comprising an end wall. The at least one housing may be configured to be in flow communication with the receptacle and may be configured to receive an applicator element. The at least one housing may optionally be axially fixed with respect to the receptacle. The device may also comprise at least one applicator element comprising a first portion and a second portion adjacent to the first portion. At least the first portion may be configured to abut the end wall when the at least one applicator element is received at least partially in the at least one housing. The device may also comprise a substantially enclosed cavity defined in the housing at least partially between the end wall and the second portion of the applicator element when the at least one applicator element is at least partially received in the at least one housing and the first portion abuts the end wall.

Optionally, the cavity may be defined in the housing when the applicator element is fully received in the housing. Alternatively, the cavity may be defined in the housing when the applicator element is partially received in the housing, and the first and second portions may contact the end wall when the applicator element is fully received in the housing.

The applicator element may be formed of open cell foam, and the cavity may be larger than the open cells of the foam.

In an aspect, the end wall of the housing may comprise a recess, and the cavity may be formed between the second portion and the recess.

In another optional embodiment, the second portion of the applicator element could comprise at least one recess, and the cavity may be defined between the recess in the end wall and the recess in the applicator element.

In another embodiment, the second portion of the applicator element may comprise at least one recess and at least one truncated portion, and the cavity may be defined between the end wall and the at least one recess and at least one truncated portion.

In yet another optional embodiment, the applicator element may be formed of a compressible material, and the first portion may be compressed to a greater degree than the second portion when the applicator element is fully received in the housing.

Optionally, the applicator element may be mounted to a cap having screw threading configured to mate with corresponding screw threading associated with at least one of the housing and the receptacle. For example, the applicator element may be fully received in the housing when the screw threadings are tightened together.

In still another optional embodiment, the housing may comprise a side wall and the applicator element may comprise a peripheral portion configured to abut the side wall when the applicator element is at least partially received in the housing. Optionally, the side wall defines at least one orifice providing flow communication between the housing and the receptacle. The end wall could also define at least one orifice providing flow communication between the housing and the receptacle.

Optionally, one or more embodiments of the invention may render it possible to provide sufficient substance on the applicator element to enable the applicator element to be used optionally for a sufficient length of time, even if the applicator element is rotated relative to the housing as the applicator element is being withdrawn.

Because in one optional embodiment, the second portion may not be compressed, or may be compressed substantially less than the first portion, the substance may more readily reach the housing in which the applicator element is placed. This may result in the substance being deposited on the surface of the applicator element.

In addition, in one optional embodiment, a portion of the applicator element may abut the wall of the housing with a degree of compression and may thereby increase the quantity of substance taken up by the applicator element due to the expansion of the applicator element while the applicator is being withdrawn. This may result in a certain amount of suction that draws substance into the applicator element.

The receptacle can contain a lotion or a cream for applying to the skin, or it can contain a lip color or care product. It could also contain a nail varnish, a hair care product, a hair color product, or any other substance desired to be applied to a surface.

When the receptacle contains a lip color product, the invention may enable the applicator element to pick up a quantity of substance sufficient to ensure that the amount of lip product deposited on the lips is large enough to produce a shiny effect, where appropriate.

Aside from the structural and procedural arrangements set forth above, the invention could include a number of other optional arrangements, such as those explained hereinafter. It is to be understood, that both the foregoing description and the following description are exemplary.

The accompanying drawings are incorporated in and constitute a part of this specification. The drawings illustrate optional embodiments of the invention and, together with the description, serve to explain some principles of the invention. In the drawings, FIG. 1 is a schematic cross-sectional view of an optional embodiment of a device for packaging and applying a substance according to an optional aspect of the invention;

Reference will now be made in detail to optional embodiments of the invention, examples of which are illustrated in the accompanying drawings. Wherever possible, the same reference numbers are used in the drawings and the description to refer to the same or like parts.

Figure 1:
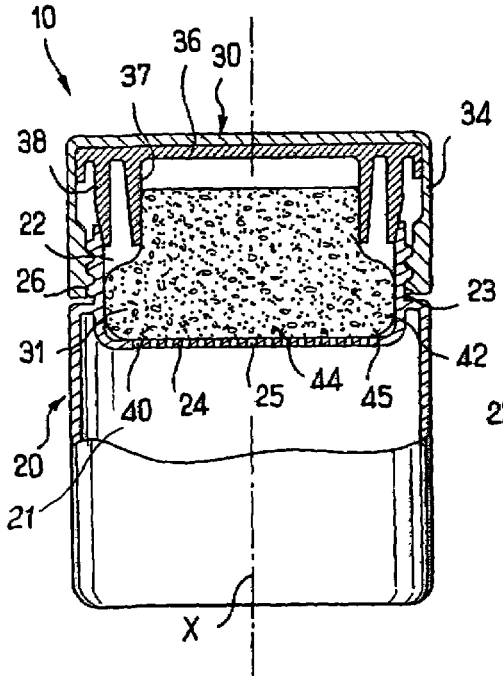

FIG. 1 shows a device 10 constituting a first optional embodiment of the invention. The device 10 may comprise a receptacle 20 having an axis X defining a space 21 for containing a substance P for application to skin, for example.

The receptacle 20 may comprise a housing 22 defined by a side wall 23 optionally about the axis X and an end wall 24 that may be optionally provided with orifices 25. When the orifices 25 are present, they may enable the housing 22 to communicate with the space 21 containing the substance P. Alternatively, the end wall 24 may comprise a porous material that enables the housing 22 to communicate with the space 21. Additionally, the housing 22 may be fixed with respect to the receptacle 20.

The device 10 also may include an applicator 30 comprising an applicator element 31. The applicator element 31 may be compressible or substantially incompressible. For example, the applicator element 31 may comprise an open-celled foam. Alternatively, the applicator element 31 may comprise a sintered material optionally flocked. The applicator element 31 may also comprise a lid 34 suitable for rotating onto a screw thread 26 of the receptacle 20. Optionally, the applicator element 31 may comprise an elastomeric material. The applicator element 31 may also be elastic and/or flexible.

The applicator element 31 may be fixed on the lid 34 by means of an optional support element 36.

The support element 36 may include an assembly skirt 37 in which the applicator element 31 may be secured by adhesive, heat-sealing, or snap-fastening. A sealing skirt 38 suitable for pressing in a sealed manner against the side wall 23 whenever the lid 34 is rotated onto the receptacle 20 may also be provided.

In an embodiment, the end wall 24 may be planar and perpendicular to the axis X.

The applicator element 31 may have a front face 40 that bears axially against the end wall 24 when the applicator 30 is located on the receptacle 20, as can be seen in FIG. 1, for example.

The applicator element 31 may also include a peripheral portion 42 that can optionally be pressed against the side wall 23 around some or all of its periphery.

Figure 3:
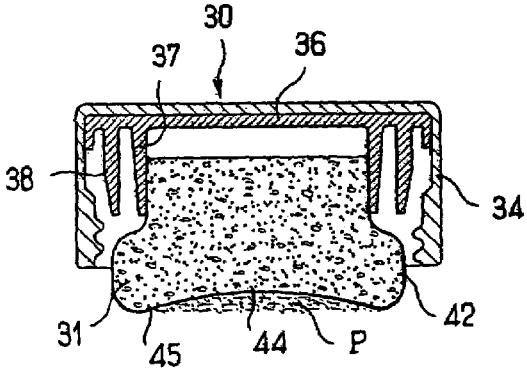
FIG. 3 is a schematic cross-sectional view of the applicator of FIG. 1.

When the applicator element 31 is removed from the receptacle 20, as can be seen in FIG. 3, for example, the applicator element 31 may include a first portion 45 and a second portion 44 surrounded by the first portion and forming an outwardly-concave depression.

Figure 2:
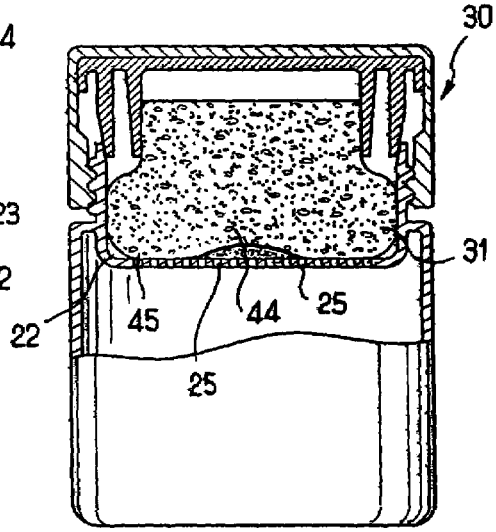
FIG. 2 is a schematic cross-sectional view of the embodiment of FIG. 1 as the applicator is being removed from the housing.

When the applicator element 31 is located in the housing 22, the front face 40 may be axially compressed and become substantially planar, fitting closely to the shape of the end wall 24. Because of the natural shape of the applicator element 31, the first portion 45 may be axially compressed to a greater extent than the second portion 44. As a result, when the lid 34 begins to be unscrewed, the second portion 44 may move away from the end wall 24 before the first portion 45 moves away from the end wall 24, as shown in FIG. 2, for example, thereby causing the substance P present in the orifices 25 or close thereto, to be sucked into the void formed by the second portion 44.

In an embodiment, the applicator element 31 may be formed of a substantially incompressible material, such as a sintered material. The housing 22 for this embodiment could be flexible. Because of the shape of the applicator element 31, the first portion 45 may be subject to a higher localized pressure than the second portion 44 when the applicator element is located at least partially in the housing 22.

In addition, when the applicator element 31 is turned by the lid 34, the substance P present in the concave depression formed by the second portion 44 may not be subjected to shear, unlike the substance P which is in contact with the first portion 45 and which may be subjected to shear by said first portion 45 rubbing against the end wall 24. As a result, the applicator element 31 may be easier to fill with substance P, in particular in the depression formed by the second portion 44.

In the optional embodiment described, withdrawing the applicator element 31 may cause a certain amount of substance P to be sucked into the housing 22 because of the contact between the peripheral portion 42 and the side wall 23. However, it would not go beyond the ambit of the present invention for the peripheral portion 42 not to press against the side wall 23 or to press thereagainst only around a portion of its periphery.

Figure 4:
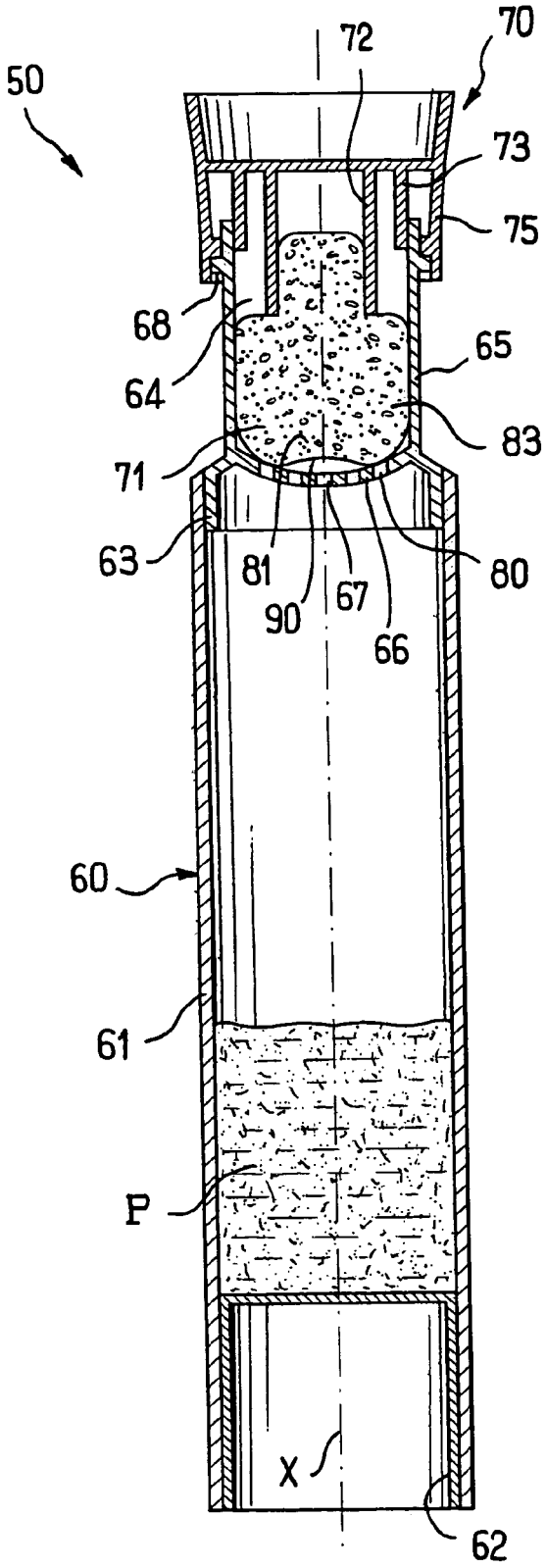
FIG. 4 is a schematic cross-sectional view of an additional optional embodiment of a device for packaging and applying a substance.

FIG. 4 shows a device 50 constituting another optional embodiment of the invention. The device 50 may comprise a receptacle 60 having an axis X, and an applicator 70 that may include an applicator element 71. The receptacle 60 may comprise a body 61 optionally filled with substance P, and may optionally be closed at one end by a fitted end piece 62, and at another end by a piece 63 defining a housing 64 for receiving the applicator element 71.

The housing 64 may be defined by a side wall 65 and by an end wall 66 provided with orifices 67 enabling the housing 64 to communicate with the interior of the body 61 of the receptacle 60. The side wall 65 may also be provided on the outside of its top portion with a screw thread 68.

The applicator 70 may include an inner skirt 72 used for mounting the applicator element 71, and a sealing skirt 73 suitable for pressing in sealed manner against the radially inner surface of the side wall 65. The applicator 70 may further include an internally threaded assembly skirt 75 suitable for rotating onto the above-mentioned thread 68.

The applicator element 71 may include a first portion 80 surrounding a second portion 81, with the second portion 81 forming a depression that is concave with respect to the end wall 66. The applicator element 71 may further include a peripheral portion 83 that presses against the side wall 65 when the applicator 70 is located on the receptacle 60. The end wall 66 may optionally be concave towards the applicator 70.

In FIG. 4, it can be seen that when the applicator 70 is in place on the receptacle 60, the first portion 80 may bear axially against the end wall 66 while the second portion 81 co-operates with the end wall 66 to leave a space 90 in which the substance P may accumulate. The peripheral portion 83 may come to bear in substantially sealed manner against the side wall 65.

By way of example, in order to load the applicator element 71 with substance P, the user may press against the wall of the body 61 of the receptacle 60 if the wall is formed from a flexible material, so as to cause the substance P to rise towards the housing 64. Alternatively, the user may substantially invert the receptacle 60 so as to allow substance P to flow under gravity down to the end wall 66 and toward the applicator element 71.

Figure 5:
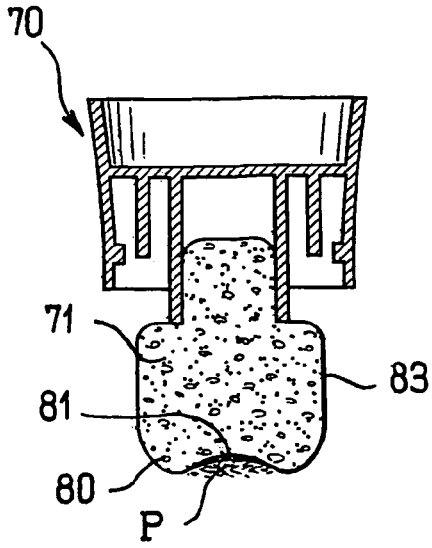
FIG. 5 is a schematic cross-sectional view of the applicator of FIG. 4.

When the applicator 70 is unscrewed, thereby raising the applicator element. 71 up the chimney formed by the side wall 65, a certain amount of substance P may be sucked (i.e., drawn) through the orifices 67. The substance P that is sucked through the orifices 67 in this manner may be taken up in the concave and/or depressed portion 81, as shown in FIG. 5, for example.

Figure 6:
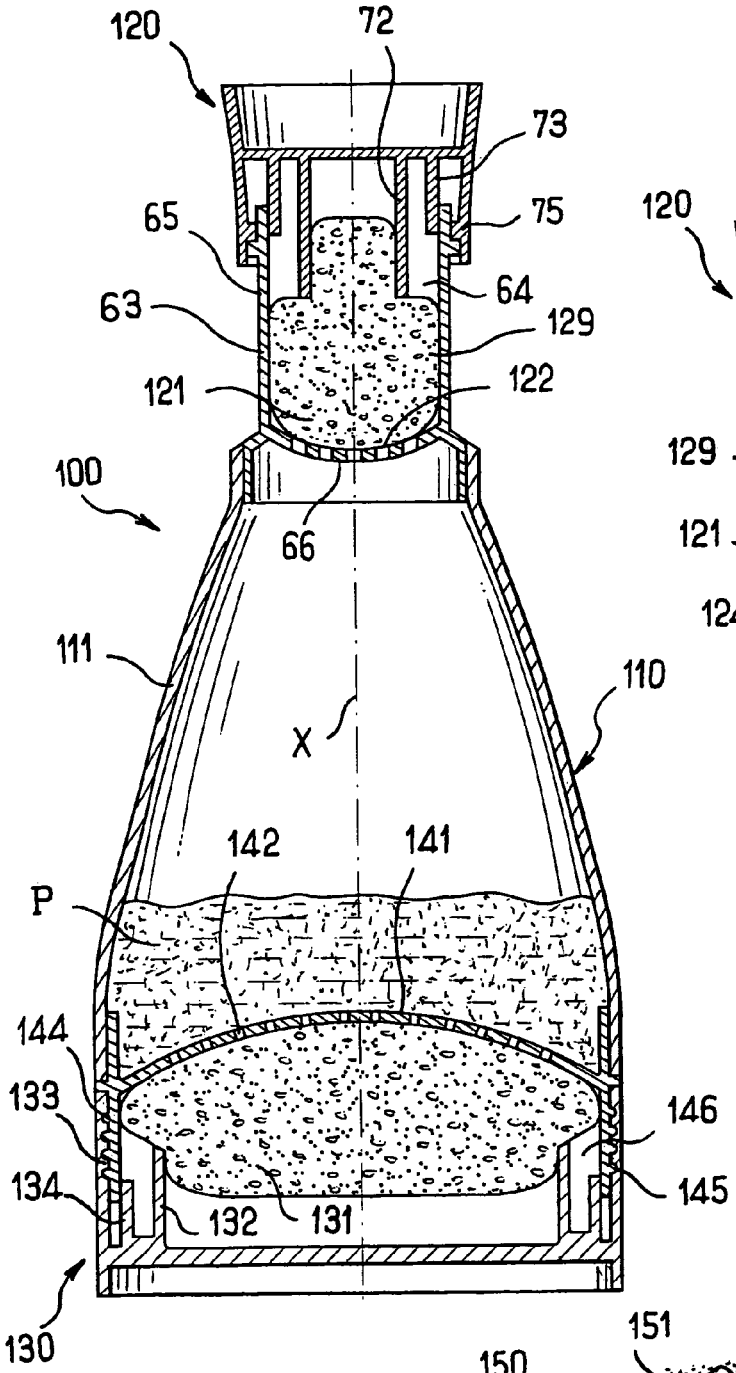
FIG. 6 is a schematic cross-sectional view of yet another optional embodiment of a device for packaging and applying a substance.

FIG. 6 shows an optional embodiment of a device 100 comprising a receptacle 110 having an axis X , which may receive two applicators 120, 130. The receptacle 110 may include a body 111, which flares downwards and whose top portion is provided with a piece 63.

The applicator 120 may differ from the above-described applicator 70 in that the shape of the applicator element 121 may be different from the applicator element 71. The applicator element 121 may have a front face 122 that may be suitable for fitting closely to the shape of the end wall 66 when the applicator is in place on the receptacle, as can be seen in FIG. 6.

Figure 8:
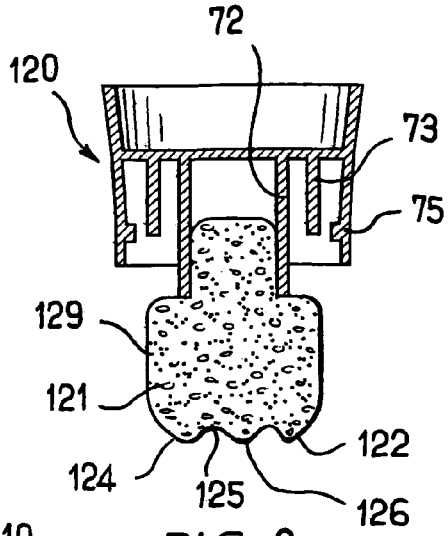
FIG. 8 is a schematic cross-sectional view of another of the applicators of FIG. 6.

When the applicator 120 is being extracted from the receptacle, the applicator element 121 may return to its initial shape and, as can be seen in FIG. 8, it may comprise a first portion 124 surrounding a second portion 125 in the form of an annular groove. This groove itself may surround a central boss 126. When the applicator 120 is in located on the receptacle 110, the front face 122 may be compressed sufficiently to eliminate its relief. While the applicator 120 is being unscrewed, the groove 125 may tend to reappear, and the resulting cavity may receive a certain quantity of substance P.

Like the applicator 70 in the above-described example, the applicator element 121 may press via a peripheral portion 129 against the side wall 65, thereby causing a certain amount of substance to be sucked into the housing 64 while the applicator 120 is being extracted from the receptacle 110. The applicator 130 may comprise an applicator element 131 secured to a support skirt 132. The applicator 130 may also include an assembly skirt 133 provided with a thread and a sealing skirt 134.

The end portion of the body 111 of the receptacle 110 may be provided with a piece 140 comprising an end wall 141 that may be provided with orifices 142 and a side wall 144 provided with an outside thread 145. The end wall 141 and the side wall 144 together may define a housing 146 for receiving the applicator element 131. The assembly skirt 133 may be suitable for rotating onto the thread 145. The sealing skirt 134 may be suitable for pressing in a sealed manner against the side wall 144.

Figure 7:
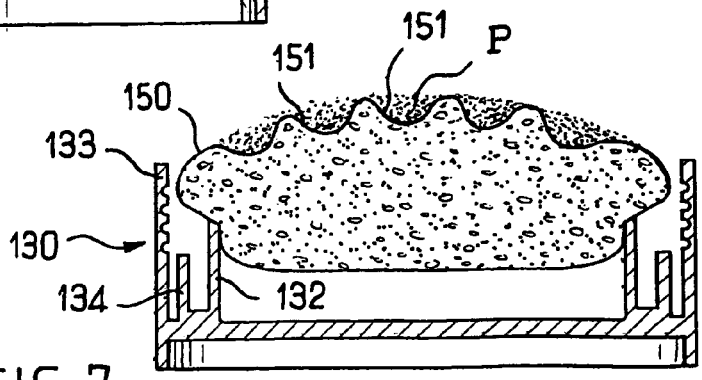
FIG. 7 is a schematic cross-sectional view of one of the applicators of FIG. 6.

When the applicator 130 is in place on the receptacle 110, the front face of the applicator element 131 may fit closely to the shape of the end wall 141 which may be concave with respect to the applicator element 131. The applicator element 131 may comprise a succession of concentric annular grooves 151 about the axis X, in which grooves 151 may become apparent once the applicator 130 has been extracted from the receptacle, as shown in FIG. 7, for example. A certain quantity of substance P may be received in these grooves 151.

Figure 9:
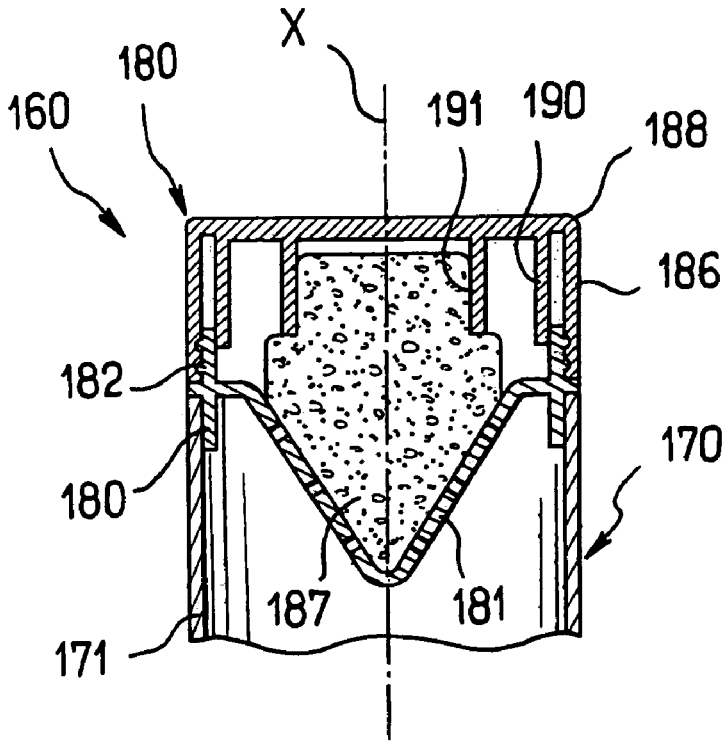
FIG. 9 is a partial schematic cross-sectional view of another optional embodiment of a device for packaging and applying a substance.

FIG. 9 shows a portion of a device 160 constituting another optional embodiment of the invention. This device 160 may include a receptacle 170 about an axis X, with only the top portion of the receptacle 170 being shown. The receptacle 170 may include a body 171 containing the substance P to be applied and provided at its top with a piece 180 comprising an end wall 181 that may be substantially conical in shape about the same axis X as the receptacle 170. The end wall 181 may be upwardly concave, and may include an assembly skirt 182 having an outside thread.

The device 160 may include an applicator 180 comprising an applicator element 187 and a lid 188. The lid may be provided with an outer skirt 186 having an inside thread suitable for rotating onto the assembly skirt 182, a sealing skirt 190 suitable for pressing in sealed manner against the radially inner surface of the assembly skirt 182, and a support skirt 191, which may serve to hold the applicator element 187.

When extracted from the receptacle 170, the applicator element 187 may be generally conical in shape and its surface may present a succession of annular grooves 189 of increasing diameter. When the applicator 180 is located on the receptacle 170, the applicator element 187 may be compressed sufficiently against the end wall 181 to ensure that the applicator element 187 fits closely substantially to the shape of the end wall 181, such as can be seen in FIG. 9.

Figure 10:
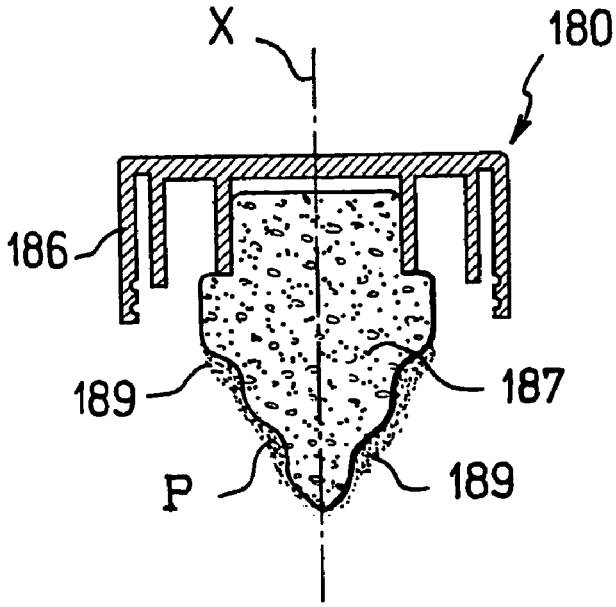
FIG. 10 is a schematic cross-sectional view of the applicator of FIG. 9.

While the applicator 180 is being unscrewed, the grooves 189 may take shape, as shown in FIG. 10, and the substance P may be received in the grooves for the purpose of being applied to the skin, for example. The substance P may become deposited on the surface of the grooves 189 when the applicator is in place on the receptacle since the material constituting the applicator element 187 may be compressed to a lesser extent in the grooves 189. However, it would not go beyond the ambit of the present invention for the applicator element 187 to be made with other shapes as well.

Figure 11:
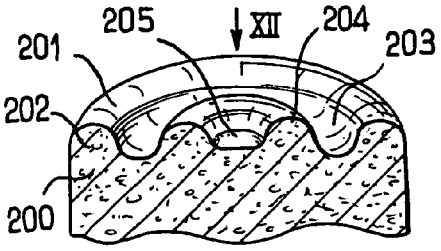
FIG. 11 is a schematic perspective cross-sectional view of an optional embodiment of an applicator element.
Figure 12:
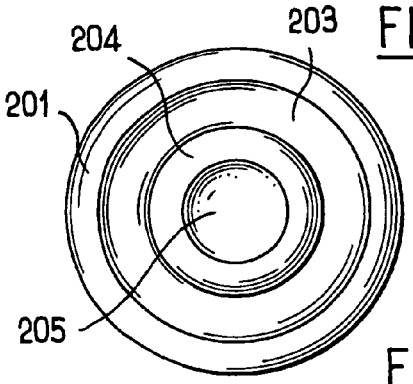
FIG. 12 is a schematic plan view of the applicator element of FIG. 11 as seen looking along arrow XII of FIG. 11.

FIGS. 11 and 12 show an optional embodiment of an applicator element 200 whose substance-applying front face 201 may include a peripheral first portion 202 surrounding a second portion 203 in the meaning of the invention which forms an annular groove 203. This groove 203 itself may extend around an annular rib 204 constituting another first portion in the meaning of the invention, in turn surrounding a central depression 205 forming another second portion in the meaning of the invention. The central depression 205 and the groove 203 may be suitable for becoming filled with substance P for application purposes.

Figure 13:
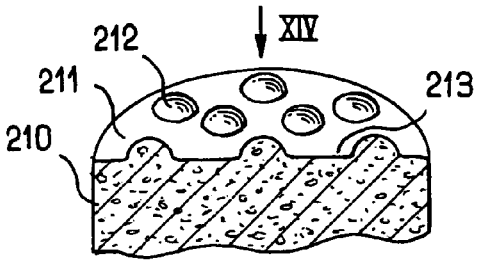
FIG. 13 is a schematic perspective cross-sectional view of yet another optional embodiment of an applicator element.
Figure 14:
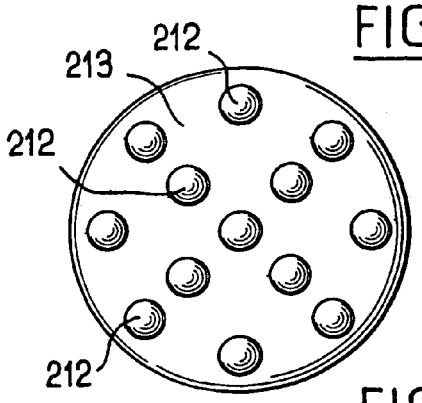
FIG. 14 is a schematic plan view of the applicator element of FIG. 13 as seen looking along arrow XIV of FIG. 13.

FIGS. 13 and 14 show yet another optional embodiment of an applicator element 210. The front face 211 of this applicator element 210 may include a set of projecting tips or bosses 212, each of which may constitute a first portion in the meaning of the invention. These tips 212 may be suitable for bearing axially against the end wall of the corresponding housing, the tips 212 projecting from a base 213 that may constitute a second portion in the meaning of the invention, surrounding the tips 212 and on which substance P may become deposited.

Figure 15:
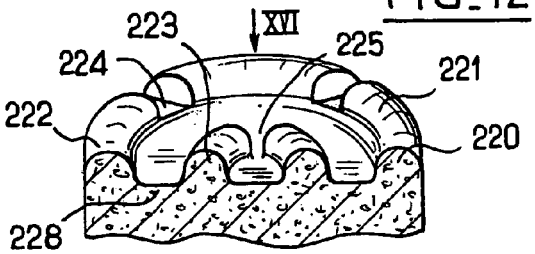
FIG. 15 is a schematic perspective cross-sectional view of an additional optional embodiment of an applicator element.
Figure 16:
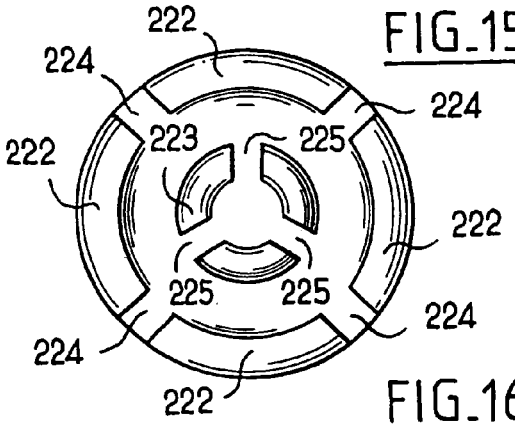
FIG. 16 is a schematic plan view of applicator element of FIG. 15 as seen looking along arrow XVI of FIG. 15.

FIGS. 15 and 16 show an additional optional embodiment of the applicator element 220, in which the front face 221 may comprise two concentric and discontinuous annular ribs 222, 223. The rib 222 may be provided with notches such as 224, and the rib 223 may be provided with notches such as 225.

In the optional embodiment described, the depth of the notches 224 may be relatively shallow and the applicator element 220 may be compressed axially to an extent sufficient to ensure that when the applicator element 220 is in place in the corresponding housing, the rib 222 may then be substantially continuous, with the notches 224 appearing only when the applicator is extracted from the receptacle. This may also apply to the notches 225. The base 228 of the applicator element 220 situated between the ribs 222 and 223 may constitute a second portion 228 in the meaning of the invention.

Figure 17:
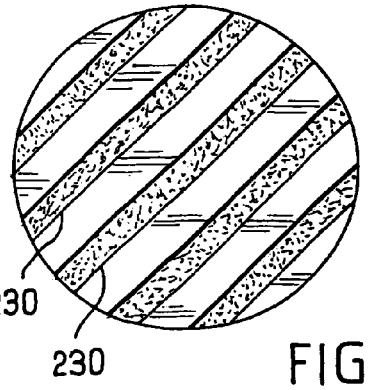
FIG. 17 is a schematic plan view of yet another optional embodiment of an applicator element.
Figure 18:
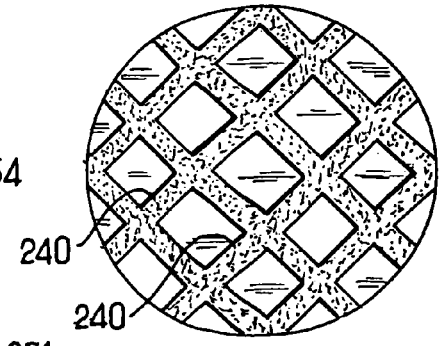
FIG. 18 is a schematic plan view of an additional optional embodiment of an applicator element.

The applicator element may also have a plurality of depressed portions in the form of grooves 230 that may be parallel and rectilinear as shown in FIG. 17, or that may be disposed in a grid configuration 240, such as shown in FIG. 18.

The applicator element may be formed as a single piece of a single material, or alternatively, by assembling together a plurality of materials of different kinds and/or textures.

Figure 19:
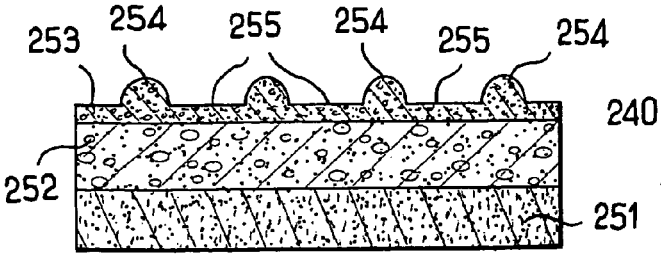
FIG. 19 is a schematic cross-sectional view of yet another optional embodiment of an applicator element.

By way of example, FIG. 19 is a section through part of an optional embodiment of an applicator element formed by superposing three layers 251, 252, and 253 that are made of three different respective materials, for example foams having different porosities. The outermost layer 253 may have projecting first portions 254 and second portions 255 set back from the first portion 254, so that the depressions in which the substance may accumulate may be formed between the first portions 254.

The housing, which receives the applicator element, may be fed with substance in numerous ways without going beyond the ambit of the present invention. For example, any known means may be used for feeding substance so that the substance contacts with the applicator element, for example a pump or a bellows.

Figure 20:
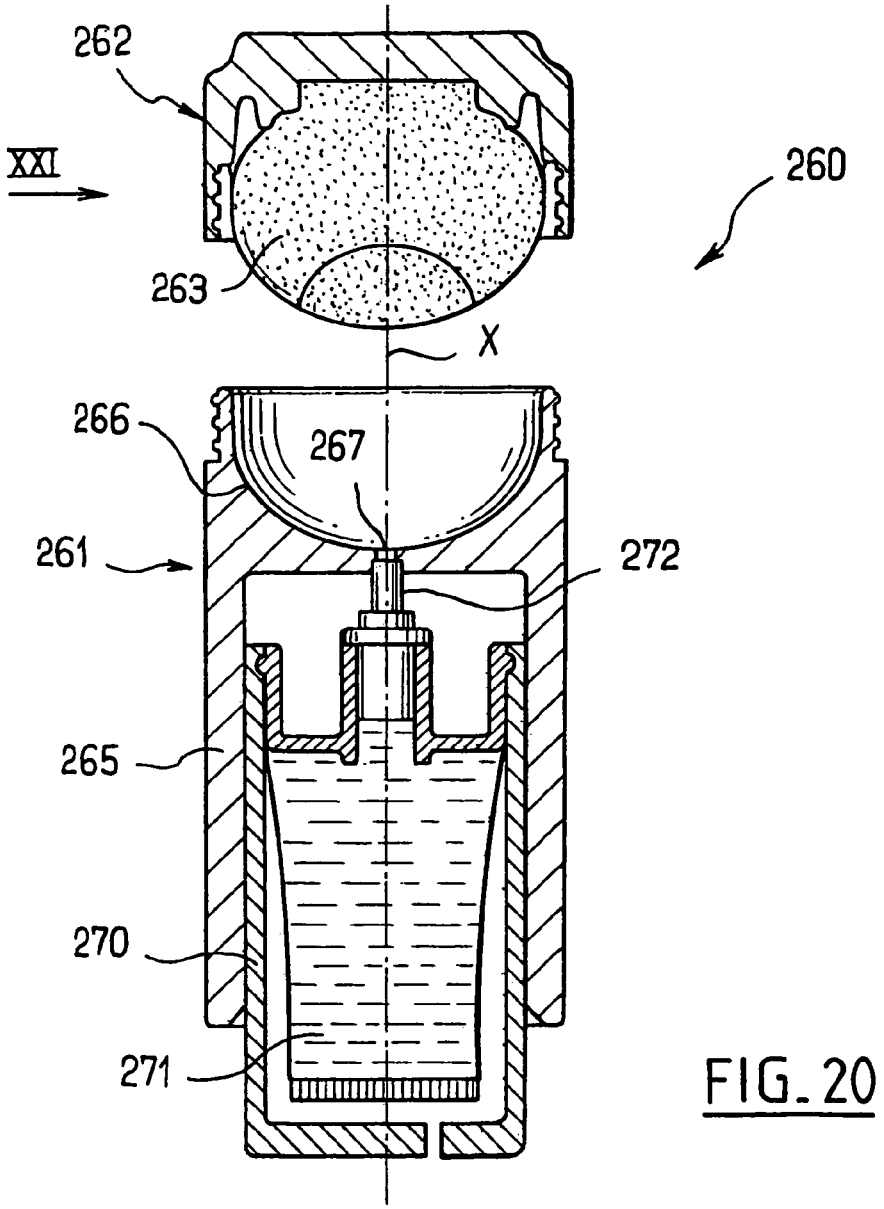
FIG. 20 is a schematic cross-sectional view of yet another optional embodiment of a device for packing and applying a substance.

FIG. 20 shows a device 260 comprising an assembly 261 that may form a receptacle and an applicator 262 having an axis X.

Figure 21:
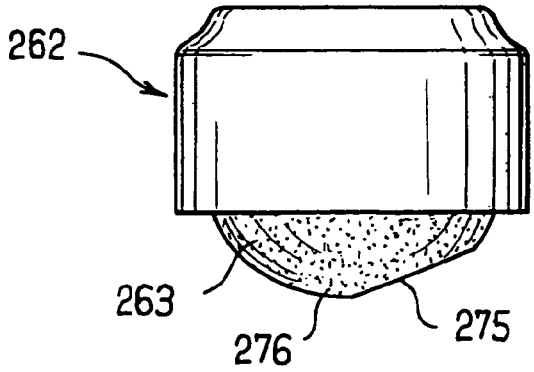
FIG. 21 is a schematic side view of the applicator of FIG. 20 as seen looking along arrow XXI of FIG. 20.

The applicator 262 may include an applicator element 263 having a bottom portion with a profile that is substantially elliptical, being optionally truncated from its apex by a plane that is inclined relative to the plane X, as can be seen in FIG. 21.

The assembly comprising the receptacle 261 may have a body 265 whose top portion defines a housing 266 for receiving the applicator element 263, the applicator 262 being optionally arranged to screw onto the top portion of the body 265.

The end wall of the housing 266 maybe pierced by a shouldered orifice 267.

The body 265 may be downwardly open to receive a refill 270 comprising a flexible bag or tube 271 feeding a pump 272 whose hollow control rod has a top end that may come to bear against the shoulder in the orifice 267.

The refill 270 can slide along the axis X inside the body 265, thereby acting on the control rod of the pump 272 and causing a quantity of substance to be dispensed into the housing 266.

The flattened portion 275 of the applicator element 263 may constitute a second portion in the meaning of the present invention, while the adjacent hemispherical portion 276 may constitute a first portion in the meaning of the invention that may come to bear axially against the end of the housing 266 when the applicator is screwed onto the body 265.

The flattened portion 275 may cooperate with the end of the housing 266 to define a substantially enclosed cavity in which the substance delivered by the control rod 272 can accumulate and become deposited on the applicator element 263.

When the applicator 262 is withdrawn, the substance may be present in sufficient quantity on the flattened portion 275 for application to the lips, for example.

Figure 22:
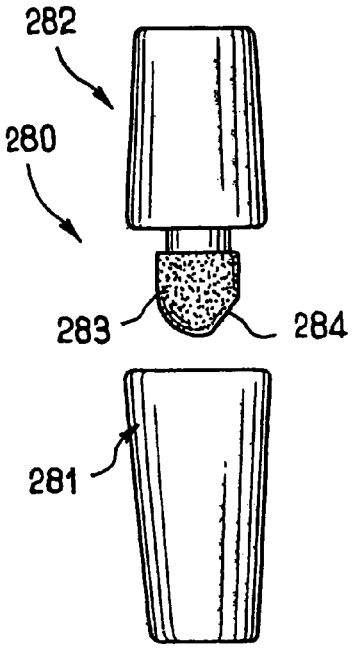
FIG. 22 is a schematic elevation view of yet another optional embodiment of a device for packaging and applying a substance.
Figure 23:
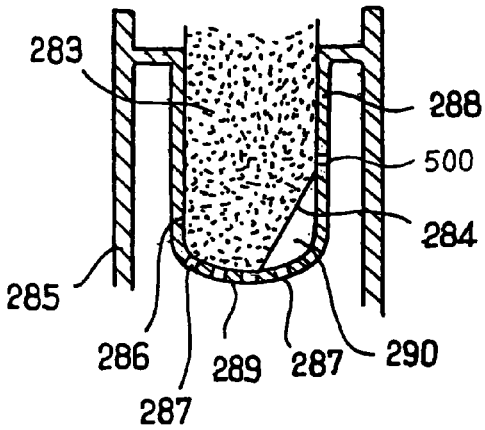
FIG. 23 is a partial schematic cross-sectional view of the embodiment of FIG. 22.
Figure 24:
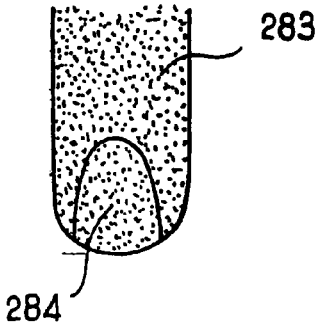
FIG. 24 is a schematic side view of an optional embodiment of applicator element of FIG. 23.

FIGS. 22 to 24 show a device 280 intended more particularly for applying lip products, for example, a lip color or care product.

The device 280 may comprise a receptacle 281 and an applicator 282. The applicator 282 may include an applicator element 283 optionally having a chamfered portion 284, which may constitute a second portion in the meaning of the present invention.

The receptacle 281 may have a body 285 defining a housing 286 provided with optional substance-feeding orifices 287 through its end wall.

As can be seen in FIG. 23, when the applicator is in place on the receptacle 281, the applicator element 283 may come to bear axially against the end wall 289 of the housing 286 and to bear radially against the side wall 288 of said housing. Optionally, the side wall 288 may comprise an orifice 500 enabling flow communication between the housing 286 and a receptacle.

The applicator element 283 may cooperate with the end wall 289 and the side wall 288 to define a cavity 290 into which at least one of the orifices 287 opens out directly.

A relatively large quantity of substance can thus be deposited on the applicator element 283 and remain thereon when the applicator is withdrawal.

In the example of FIGS. 22 to 24, the applicator element 283 may have a chamfered portion 284.

Figure 25:
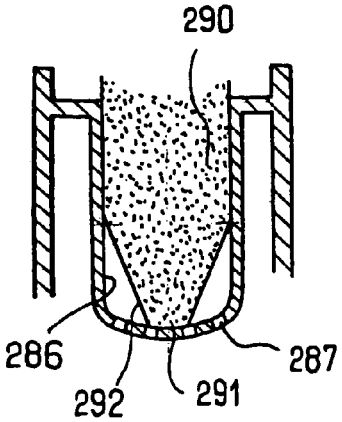
FIG. 25 is a partial schematic cross-sectional view of yet an additional embodiment of an applicator element received in a housing.

The applicator element can also be substantially frustoconical at its bottom end, as shown in FIG. 25. In this embodiment, the applicator element 298 may comprise a frustoconical bottom end whose bottom tip 291 may constitute a first portion in the meaning of the present invention and may come to bear against the end wall of the housing 286.

The conical portion 292 may constitute a second portion in the meaning of the present invention, since it is not compressed against the wall of the housing when the applicator is in place on the receptacle.

A cavity 299 may be formed between the applicator element 298 and the wall of the housing.

Figure 26:
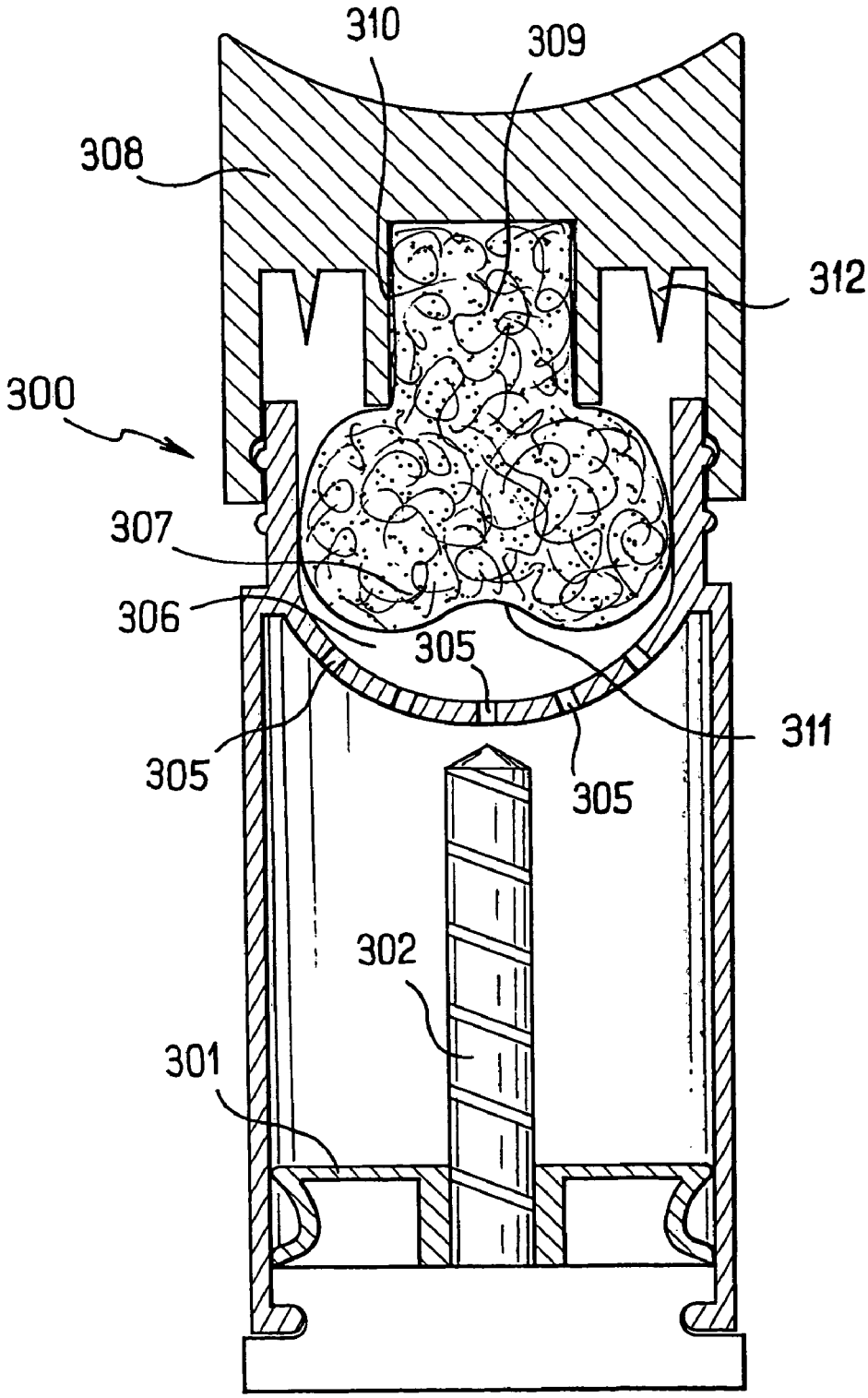
FIG. 26 is a schematic cross-sectional view of yet another optional embodiment of a device for packaging and applying a substance.

As shown in FIG. 26, a piston may be provided to enable delivery of a product from the receptacle to the housing and the applicator element. For example, a device 300 may comprise a receptacle having a piston 301, which can be advanced by rotating a screw 302.

The product can flow from inside the receptacle into the housing 306 through at least one orifice 305, for example, a plurality of orifices 305.

An applicator element 307 can be received within the housing 306. The applicator element 307 can be fixed to a cap 308. A portion 309 of the applicator element 307 can be fixed to cavity 310 of the cap 308, for example. The applicator element 307 may have a recess 311 in a central portion, for example. The cap 308 may be provided with a sealing lip 312.

Alternatively, product can be fed into the housing by means different from a piston without departing from the scope of the invention.

Figure 27:
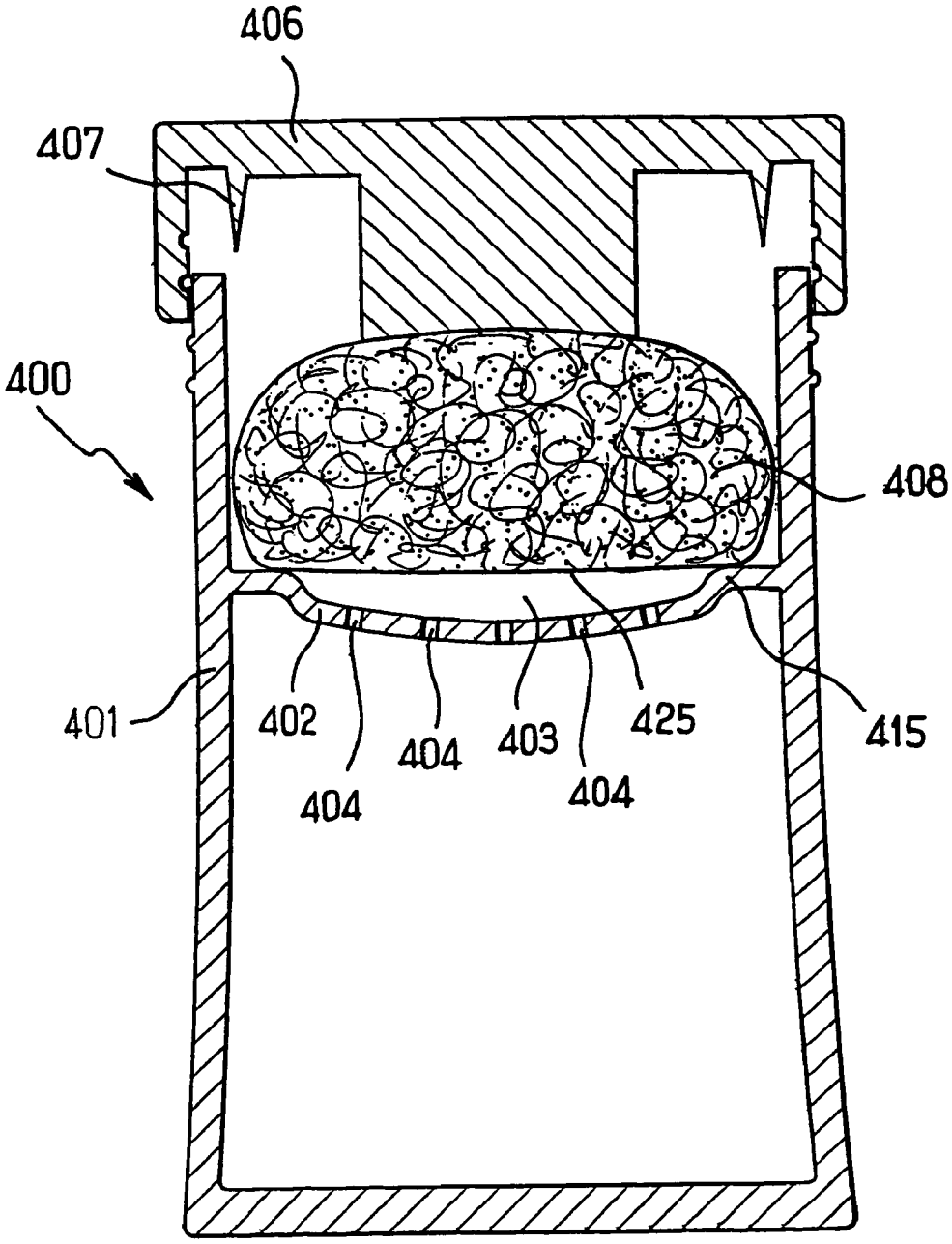
FIG. 27 is a schematic cross-sectional view of an additional optional embodiment of a device for packaging and applying a substance.

In another embodiment, the housing in which the applicator element is received can be provided with at least one recess as shown, for example, in the device 400 of FIG. 27. The device 400 may comprise a housing 401 having an end wall 402 configured to form a recess 403. At least one opening 404 (e.g., a plurality of openings 404) may open out in the recess 403, as shown.

Figure 28:
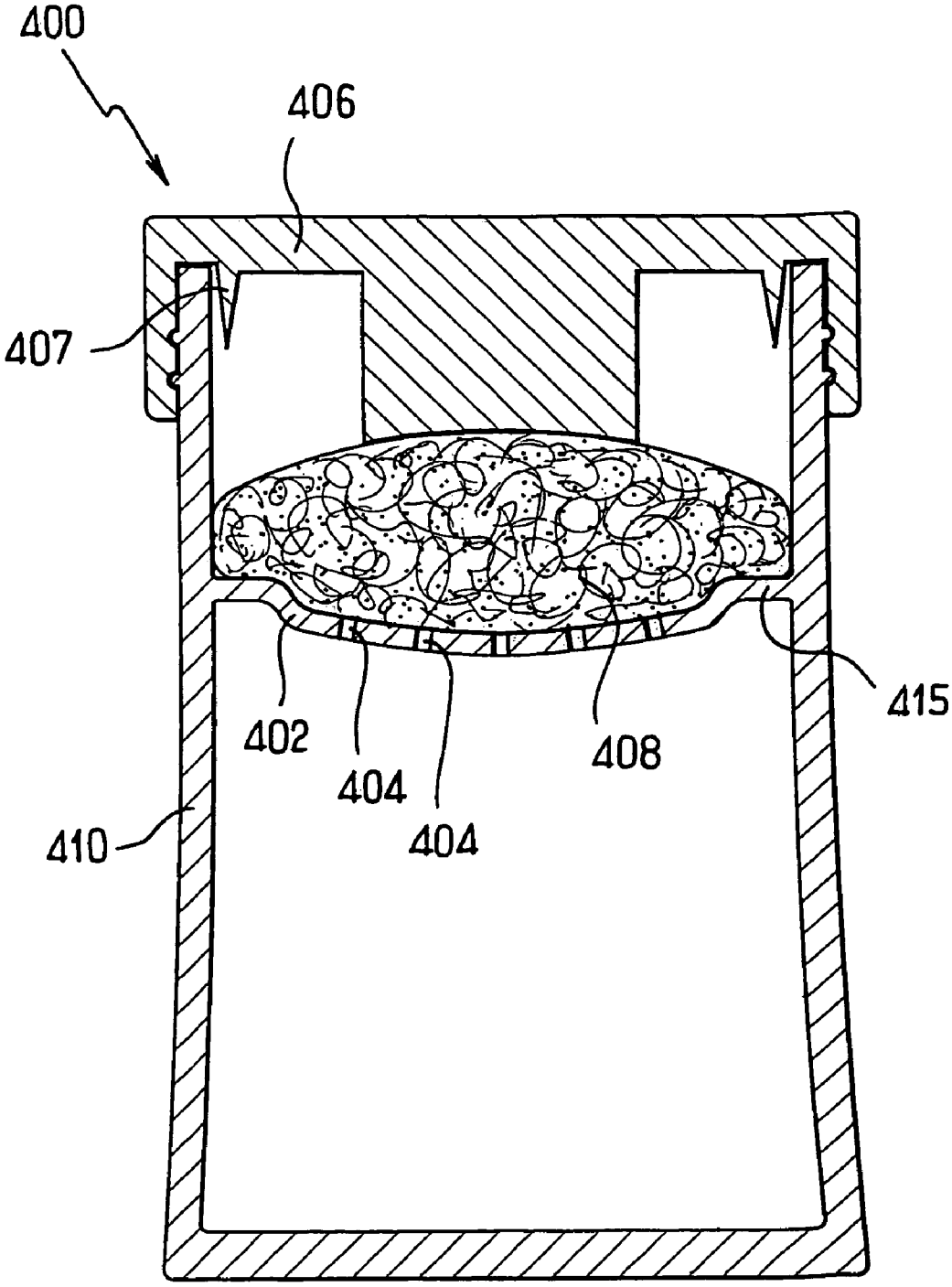
FIG. 28 is a schematic cross-sectional view of the embodiment of FIG. 27 with the applicator received in the housing.

The applicator element 408 may be fixed to a cap 406. Such a cap 406 may comprise a sealing lip 407, and may be screwed onto the receptacle 410. When the cap 406 is screwed onto the receptacle 410, the applicator element 408 may engage the recess 403, as shown in FIG. 28, for example. The front face 425 of the applicator element may then optionally come into contact with the bottom of the recess 403.

When the cap is unscrewed, a pumping effect may occur due to the formation of a cavity between the bottom of the recess and the applicator element 408, and due to the fact that the applicator element 408 is in contact around this cavity with an annular portion 415 of the end wall 402. The applicator element 408 may also come into to contact with a side wall of the housing. Such a pumping effect may facilitate the loading of the applicator element 408. The pumping effect may enable the orifices 404 to be made small while still having a satisfactory product delivery rate. The fact that orifices 404 can be made small may reduce unwanted product leakage.

The invention also may make it possible using a common receptacle to give the user a different feel depending on the shape given to the applicator element, with the feel depending in particular on the quantity of substance that accumulates locally and preferentially on the applicator element because of the presence of its first and second portions in accordance with the invention.

The products used in accordance with the invention may include any make-up or care products, such as cosmetic, dermatological, or pharmaceutical compositions used for treating hair, skin, lips, or nails. However, in its broadest aspects, the present invention could be used to package many other objects and substances.

Furthermore, sizes of various structural parts and materials used to make the above-mentioned parts are illustrative and exemplary only, and one of ordinary skill in the art would recognize that these sizes and materials can be changed as necessary to produce different effects or desired characteristics of the device for packaging and applying a substance.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. A device for packaging and applying a substance, the device comprising:

a receptacle for containing the substance;

at least one housing comprising a substantially conical-shaped wall, the at least one housing being configured to receive an applicator element; and at least one applicator element, the at least one applicator element being compressible and comprising a first portion configured to abut the substantially conical-shaped wall when the at least one applicator element is received at least partially in the at least one housing and the first portion in an uncompressed configuration, and a second portion comprising at least one recess, the second portion being configured to abut the substantially conical-shaped wall when the at least one applicator element is at least partially received in the at least one housing and the first portion is in a compressed configuration.

2. The device of claim 1, wherein the at least one applicator element further comprises a sealing member configured to close the at least one housing in a sealed manner when the at least one applicator element is received at least partially in the at least one housing.

3. The device of claim 1, wherein the substantially conical-shaped wall has a portion defining at least one orifice configured to supply the at least one applicator element with the substance.

4. The device of claim 3, wherein the substantially conical-shaped wall comprises a plurality of orifices configured to supply the at least one applicator element with the substance.

5. The device of claim 1, wherein the second portion is configured to be compressed in an axial direction when the at least one applicator element is received in the at least one housing.

6. The device of claim 5, wherein the at least one applicator element is configured to contact substantially the entire substantially conical-shaped wall when the at least one applicator element is received in the at least one housing.

7. The device of claim 1, wherein the at least one applicator element further comprises a lid, the lid being configured to be secured to the at least one housing by rotation and to provide a handle.

8. The device of claim 1, wherein the at least one applicator element further comprises a lid, the lid being configured to be secured to the at least one housing by translation and to provide a handle.

9. The device of claim 1, wherein the at least one applicator element comprises at least one depressed portion defined by a groove.

10. The device of claim 9, wherein the at least one applicator element comprises a plurality of parallel grooves.

11. The device of claim 1, wherein the at least one applicator element comprises an open-cell foam.

12. The device of claim 1, wherein the first portion is radially symmetrical in shape.

13. The device of claim 1, wherein the first portion comprises regions having different heights in the uncompressed configuration, and wherein the regions having different heights abut the substantially conical-shaped wall in the compressed configuration when the at least one applicator element is received in the at least one housing.

14. The device of claim 1, wherein the interior of the at least one housing is separated from the substance by the substantially conical-shaped wall.

15. The device of claim 1, wherein the substantially conical-shaped wall is fixed with respect to the receptacle.

16. The device of claim 1, further comprising a pump for delivering substance into the at least one housing.

17. The device of claim 1, wherein the substance is supplied to the at least one applicator element by capillary action.

18. The device of claim 1, wherein the at least one applicator element is configured such that the substance is drawn into the at least one housing as the at least one applicator element is removed from the housing thereby creating a suction effect.

19. The device of claim 1, wherein the first portion is configured to be in a compressed configuration when the at least one applicator element is received in the at least one housing and to expand as the at least one applicator element is removed from the at least one housing, thereby drawing a supply of the substance into the at least one housing.

20. The device of claim 1, wherein the receptacle is configured to elastically deform, and wherein a supply of the substance is delivered into the at least one housing upon compression of the receptacle.

21. The device of claim 1, wherein the at least one applicator element has an uncompressed configuration when the at least one applicator element is not received in the at least one housing and a compressed configuration when the at least one applicator element is received within the at least one housing.

22. The device of claim 1, wherein the receptacle contains a care product for application to skin.

23. The device of claim 22, wherein the care product comprises one of a lotion and a cream.

24. The device of claim 1, wherein the receptacle contains cosmetic product.

25. The device of claim 1, wherein the receptacle contains one of a lip care product and a lip make-up product.

26. A method of applying a substance to skin, the method comprising:

providing a substance in the receptacle of the device of claim 1;

delivering a supply of the substance from the receptacle to the at least one applicator element;

removing the at least one applicator element from the at least one housing; and applying the substance to the skin.

27. The method of claim 26, wherein the delivering of the supply of the substance to the at least one housing comprises drawing the supply of the substance into the at least one housing as the at least one applicator element slides on the substantially conical-shaped wall thereby creating a suction effect.

28. The method of claim 26, wherein the at least one applicator element expands as the at least one applicator element is removed from the at least one housing.

29. The method of claim 26, wherein the substance is a care product comprising one of cream and lotion.

30. The method of claim 26, wherein the delivering of the substance comprises activating a pump to move the substance through the at least one orifice.

31. A device for packaging and applying a substance, the device comprising:

a receptacle for containing the substance;

at least one housing capable of being in flow communication with the receptacle, the at least one housing being configured to receive an applicator element;

at least one recess defined by the at least one housing; and at least one applicator element, the at least one applicator element being capable of occupying at least a major part of the at least one recess when the at least one applicator element is received at least partially in the at least one housing, wherein the at least one housing and the receptacle are in flow communication upon removal of the at least one applicator element from the at least one housing, and the device is configured such that the at least one applicator element is removable from the at least one housing during use, wherein the housing and the at least one applicator element are configured such that the at least one applicator element is axially compressed when the at least one applicator element is at least partially received within the housing, and wherein the at least one applicator element comprises compressible material and the at least one housing defines a side wall, and the compressible material contacts the side wall when the at least one applicator element is received in the at least one housing.

32. The device of claim 31, wherein the at least one housing comprises at least one orifice configured to provide flow communication between the at least one housing and the receptacle.

33. The device of claim 31, wherein the at least one housing comprises at least one end wall, wherein the at least one end wall is flexible.

34. The device of claim 31, wherein the at least one housing comprises at least one end wall having a stepped portion, the at least one recess being defined by the stepped portion of the at least end one wall.

35. The device of claim 31, wherein the at least one housing comprises at least one end wall defining the recess, the at least one end wall comprising at least one orifice configured to provide flow communication between the housing and the receptacle.

36. The device of claim 35, wherein the at least one end wall is flexible.

37. The device of claim 31, wherein the at least one applicator element is compressible.

38. The device of claim 31, wherein the at least one applicator element comprises a substantially planar face when the at least one applicator element is in an uncompressed configuration.

39. The device of claim 31, wherein the at least one applicator element comprises at least one recess.

* * * * *